US009416591B2

(12) United States Patent
Kieffer et al.

(10) Patent No.: US 9,416,591 B2
(45) Date of Patent: Aug. 16, 2016

(54) TELESCOPING LADDER WITH STABILIZERS

(71) Applicant: Core Distribution, Inc., Minneapolis, MN (US)

(72) Inventors: Mitchell I. Kieffer, Minneapolis, MN (US); Allen A. Caldwell, Shakopee, MN (US)

(73) Assignee: Core Distribution, Inc., Minneapolis, MN (US)

( * ) Notice: Subject to any disclaimer, the term of this patent is extended or adjusted under 35 U.S.C. 154(b) by 0 days.

(21) Appl. No.: 14/558,042

(22) Filed: Dec. 2, 2014

(65) Prior Publication Data

US 2016/0153232 A1 Jun. 2, 2016

(51) Int. Cl.

| | |
|---|---|
| ***E06C 1/18*** | (2006.01) |
| ***E06C 1/383*** | (2006.01) |
| ***E06C 1/12*** | (2006.01) |

(52) U.S. Cl.

CPC ..... *E06C 1/3835* (2013.01); *E06C 1/125* (2013.01); *E06C 1/18* (2013.01)

(58) Field of Classification Search

CPC ..... E06C 1/125; E06C 1/18; E06C 1/3835

See application file for complete search history.

(56) References Cited

U.S. PATENT DOCUMENTS

| | | | |
|---|---|---|---|
| 2,127,035 | A | 8/1938 | Kirlin |
| 2,827,216 | A | 3/1958 | Napolitano |
| 4,152,810 | A | 5/1979 | Martinez |
| 4,376,470 | A | 3/1983 | Ashton et al. |
| 4,549,632 | A | 10/1985 | Inoue |
| 4,566,150 | A | 1/1986 | Boothe |
| 4,770,559 | A | 9/1988 | Yoo |
| 5,058,239 | A | 10/1991 | Lee |
| 5,074,377 | A | 12/1991 | Krause |
| 5,142,739 | A | 9/1992 | Lin |
| 5,620,272 | A | 4/1997 | Sheng |
| 5,738,186 | A | 4/1998 | Jones |
| 5,775,460 | A | 7/1998 | Stone |
| 5,954,157 | A | 9/1999 | Grimes et al. |
| 5,992,566 | A | 11/1999 | Yeh |

(Continued)

FOREIGN PATENT DOCUMENTS

| | | | | |
|---|---|---|---|---|
| DE | 20207715 | U1 | 9/2003 | |
| DE | 202013009466 | U1 * | 11/2013 | ..... E06C 7/44 |

(Continued)

OTHER PUBLICATIONS

U.S. Appl. No. 14/557,944, filed Dec. 2, 2014, 35 pages.

(Continued)

*Primary Examiner* — Alvin Chin-Shue

(74) *Attorney, Agent, or Firm* — Fredrikson & Byron, P.A.

(57) ABSTRACT

A telescoping ladder includes a stabilizer connected to a stabilizer housing proximal to the floor surface on which the ladder is positioned. The first stabilizer can move between an extended position and a collapsed position. In the extended position, the first stabilizer extends out of a hollow body portion of the stabilizer housing and collapse into the hollow body portion of the rung in the collapsed position. The stabilizer comprises a locking button to lock the stabilizer in its extended position. The ladder comprises a flange that can release the locking button thereby unlocking the stabilizer from its extended position and move it into the collapsed position.

15 Claims, 10 Drawing Sheets

(56) References Cited

U.S. PATENT DOCUMENTS

| | | | | |
|---|---|---|---|---|
| 6,343,406 | B1 | 2/2002 | Yeh | |
| 6,857,503 | B2 | 2/2005 | Simpson | |
| 6,883,645 | B2 | 4/2005 | Kieffer et al. | |
| 6,993,808 | B1 | 2/2006 | Bennett et al. | |
| 7,007,344 | B2 | 3/2006 | Lee | |
| 7,047,597 | B2 | 5/2006 | Lee | |
| 7,140,072 | B2 | 11/2006 | Leng | |
| 7,306,075 | B2 | 12/2007 | Winslow et al. | |
| 7,364,017 | B2 | 4/2008 | Moss et al. | |
| 8,348,015 | B2 | 1/2013 | Parker | |
| 8,387,753 | B2 | 3/2013 | Kieffer et al. | |
| 8,591,444 | B2 | 11/2013 | Bejarano et al. | |
| 9,126,622 | B2 | 9/2015 | Hebenstreit et al. | |
| 2003/0012595 | A1 | 1/2003 | Park | |
| 2003/0062219 | A1 | 4/2003 | Yeh | |
| 2003/0127288 | A1 | 7/2003 | Ed | |
| 2003/0217888 | A1 | 11/2003 | Simpson et al. | |
| 2004/0129497 | A1 | 7/2004 | Weiss | |
| 2006/0155230 | A1 | 7/2006 | Mason et al. | |
| 2006/0283664 | A1 * | 12/2006 | Yao | E06C 7/06 182/156 |
| 2007/0067957 | A1 | 3/2007 | Moore | |
| 2007/0201943 | A1 | 8/2007 | Yeh | |
| 2008/0000723 | A1 | 1/2008 | Kieffer et al. | |
| 2008/0073150 | A1 | 3/2008 | Lin | |
| 2008/0109994 | A1 | 5/2008 | Liao | |
| 2009/0050407 | A1 | 2/2009 | Eriksson | |
| 2009/0078503 | A1 * | 3/2009 | Eriksson | E06C 1/125 182/18 |
| 2011/0056764 | A1 | 3/2011 | Cross et al. | |
| 2012/0267197 | A1 | 10/2012 | Kieffer et al. | |
| 2015/0204138 | A1 * | 7/2015 | Weston | E06C 1/125 182/207 |
| 2015/0315844 | A1 | 11/2015 | Miao | |

FOREIGN PATENT DOCUMENTS

| | | | | |
|---|---|---|---|---|
| TW | CA 2157842 | A1 * | 3/1997 | E06C 1/125 |
| WO | 2004044365 | A2 | 5/2004 | |
| WO | 2009057995 | A1 | 5/2009 | |

OTHER PUBLICATIONS

International Search Report for International Application No. PCT/US2015/063518, Date of Mailing: May 10, 2016, 22 pages.

* cited by examiner

TELESCOPING LADDER WITH STABILIZERS

FIELD

This disclosure generally relates to ladders and more particularly to telescoping ladders.

BACKGROUND

Ladders typically include rungs supported between stiles formed from a plurality of columns. In some cases, the ladder can be a telescoping ladder and can be expanded to separate the columns from one another for extension of the ladder, or collapsed together for retraction of the ladder.

SUMMARY OF THE INVENTION

Certain embodiments of the invention include a telescoping ladder, comprising a first stile, a second stile each having a plurality of columns disposed in a nested arrangement for relative axial movement in a telescopic fashion along an axis of the plurality of columns between an extended position and a collapsed position. A first column proximal to the floor surface has a flange positioned in the hollow body of the first column coaxially with the axis of the plurality of columns. The ladder comprises a plurality of rungs extending between the first stile and the second stile. Each rung is connected to a column of the first stile and a column of the second stile. A first stabilizer housing proximal to the floor surface on which the telescoping ladder is positioned is connected to the first and second columns.

In certain embodiments, the telescoping ladder comprises a first stabilizer connected to the first stabilizer housing. The first stabilizer can move between an extended position and a collapsed position, wherein, in the extended position, the first stabilizer extends out of a hollow body portion of the first stabilizer housing past the first stile in a direction substantially normal to the axis of the plurality of columns in the extended position. The first stabilizer collapses into the hollow body portion of the first stabilizer housing in the collapsed position. The first stabilizer comprises a hollow body in sliding engagement with an interior surface of the first stabilizer housing, and a locking button adapted to protrude past an aperture defined on the first stabilizer housing to lock the first stabilizer in its extended position.

In certain embodiments, the locking button and the aperture are coaxial to the axis of the plurality of columns in the extended position of the first stabilizer. In such embodiments, the flange can abut against the locking button protruding past the aperture of the first stabilizer housing due to the telescoping movement of the first column toward the first stabilizer housing. The abutment of the flange against the locking button pushes the locking button away from the aperture and thereby unlocking the first stabilizer from its extended position and into the collapsed position.

In certain embodiments, the ladder is a foldable telescoping ladder, comprising a first ladder portion, a second ladder portion hingedly connected to the first ladder portion such that the first and second ladder portions are rotatable about a hinge axis. At least one of the first and second ladder portions can have a rung comprising a pair of stabilizers adapted to extend past each of the first and second stiles of the first ladder portion in a direction substantially normal to the axis of the plurality of columns and collapse into a hollow body portion of the first stabilizer housing.

BRIEF DESCRIPTION OF DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1A:
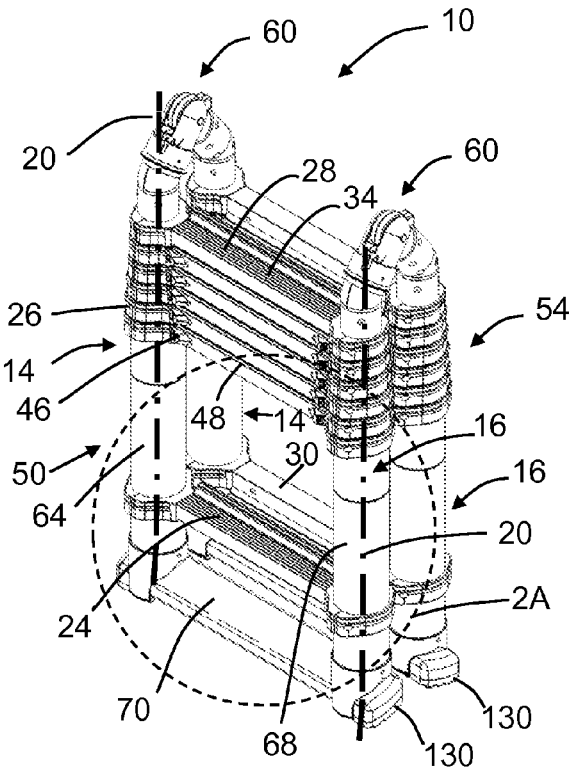
FIG. 1A is a perspective view of a foldable ladder locked at a first angular position according to an embodiment.
Figure 1B:
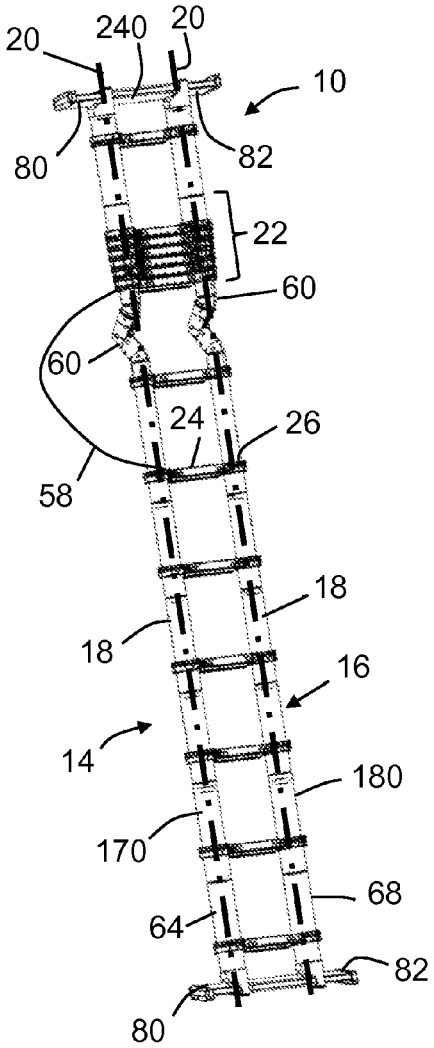
FIG. 1B is a perspective view of the foldable ladder of FIG. 1A locked at a second angular position in a collapsed state.
Figure 1C:
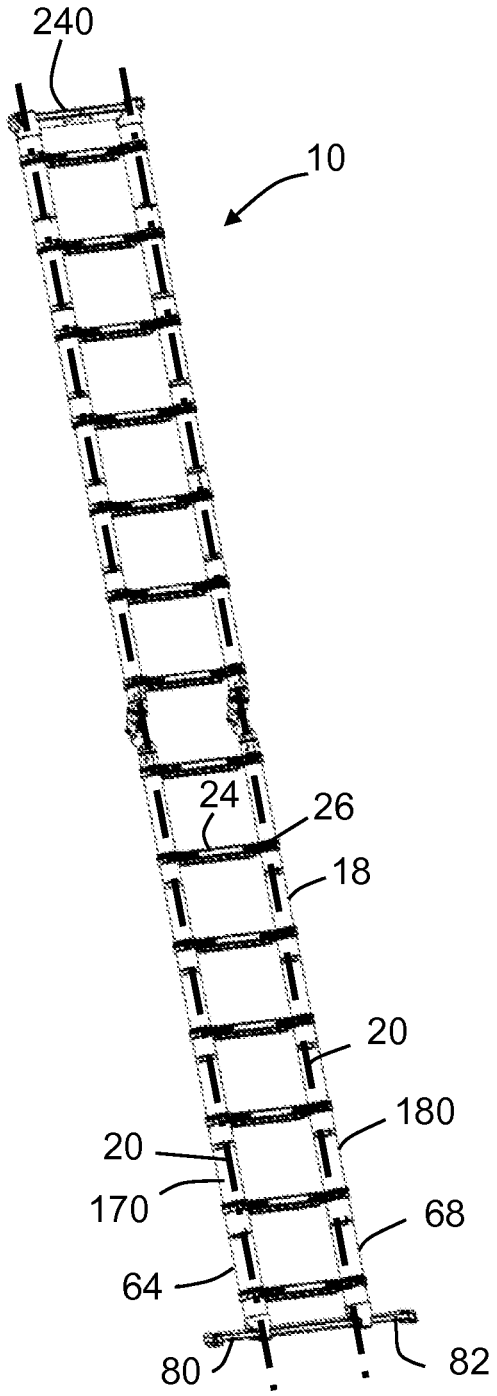
FIG. 1C is a perspective view of the foldable ladder of FIG. 1B shown in an extended state.
Figure 1D:
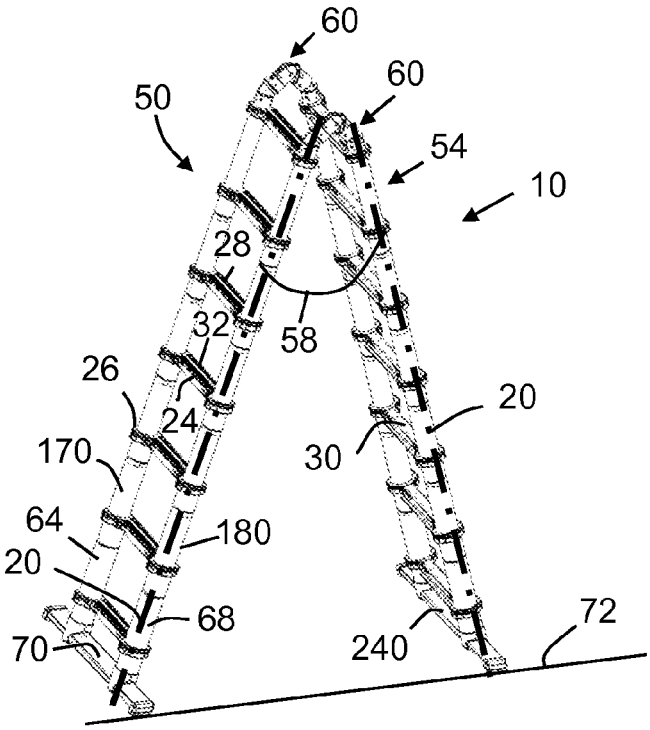
FIG. 1D is a perspective view of the foldable ladder of FIG. 1A locked at a third angular position.

FIG. 1A is a front perspective view of a ladder 10 according to some embodiments. FIGS. 1B-1D are front perspective views of a ladder 10 unfolded from its folded position illustrated in FIG. 1A and locked at various angles, according to some embodiments. In FIGS. 1B and 1C, the ladder 10 has been unfolded from its folded position in FIG. 1A and locked at an angle of about 180 degrees In FIG. 1D, the ladder 10 has been locked at an angle of about 30 degrees. In FIG. 1B an upper portion 22 of the ladder 10 is in a collapsed state, whereas in FIG. 1C, the upper portion 22 of the ladder 10 is in an extended state.

Referring now to FIG. 1A, the telescoping ladder 10 comprises a first stile 14 and a second stile 16 (e.g., left hand and right hand stiles illustrated in FIG. 1A). The first and second stiles each have a plurality of columns 18 disposed in a nested arrangement for relative axial movement in a telescopic fashion along an axis 20 of the plurality of columns 18 between an extended position and a collapsed position. For instance, in FIG. 1*a*, an upper portion 22 of the ladder 10 is shown in a collapsed position where the columns 18 are nested within each other along the axis 20 of the columns 18 in a telescoping fashion, and in FIG. 1D, the upper portion 22 of the ladder 10 is shown in an extended position.

As seen in FIG. 1A, the ladder 10 comprises a plurality of rungs 24 extending between the first stile 14 and the second stile 16. Each rung 24 can be connected to a column 18 of the first stile 14 and a column 18 of the second stile 16. As shown in FIG. 1A, each rung 24 can be connected to the columns 18 by a connector assembly 26. With continued reference to FIG. 1A, in some cases, each rung 24 comprises a planar first surface 28 and a planar second surface 30 opposite to the planar first surface 28. The first surface 28 of each rung 24 of the first ladder portion 50 defines a planar standing surface 32. At least one of the planar first and second surfaces 28, 30 of the second ladder portion 54 defines a planar standing surface 32. Referring to FIGS. 1B and 1C, when the ladder 10 is unfolded for use, the first surface 28 of each rung 24 of the second ladder portion 54 has a planar standing surface. However, when ladder 10 is folded for storage or unfolded to angles other than about 180 degrees (e.g., as shown in FIG. 1A or 1D), the first surface 28 of each rung 24 of the second ladder portion 54 may not face the top and therefore the planar standing surface 32 may be defined on the underside of the rung 24 when the rung 24 is folded for storage or unfolded to angles other than 180 degrees. The planar standing surface 32 of each rung 24 of the first and second ladder portions 50, 54 may have treads 34 defined therein to provide friction between the planar standing surface and the contact surface of a user (e.g., soles of the user's shoes). As will be described herein, the rungs 24 can be substantially hollow so as to allow a connector assembly 26 to fasten the rung 24 to a column 18 on each of the right-hand stile and left-hand side stile. The rungs 24 can be extruded from aluminum, although other materials and means of manufacturing can also be used.

While FIGS. 1A-1D illustrate a rung 24 with a substantially rectangular cross-section, other cross-sectional shapes of the rung 24 are also contemplated. For instance, the rung 24 can have a parallelogram cross-section such as those illustrated in U.S. Publication No. 2012/0267197 A1, assigned to the assignee of the instant application, the disclosure of which is hereby incorporated by reference in its entirety. While the illustrated FIGS. 1A-1D show a substantially rectangular rung 24, as best seen in FIG. 2D, at least a portion 38 of the first surface 28 of the first and second ladder portions 50, 54 can form an angle θ with respect to a horizontal plane 42. In the illustrated embodiment, when the angled portion 38 of the first surface 28 form an angle with respect to a horizontal plane (not shown). The angled portion 38 can form an angle between about 5 degrees and 45 degrees (e.g., between 5 degrees and 20 degrees) with respect to the horizontal plane 42. Such embodiments allow at least the angled portion 38 of the first surface 28 of the rung 24 to be horizontal when the ladder 10 is rotated towards a vertical wall (e.g., propped against a wall at an angle) so that during normal use, at least a portion 38 of the rung 24 can be nearly horizontal. However, depending on the angle at which the ladder 10 is propped against a vertical wall, the angled portion 38 may be past or short of being horizontal.

In some embodiments, the columns 18 are made of aluminum. Other materials are contemplated and are within the scope of the invention. The columns 18 are illustrated as having a circular cross-section (when viewed along the axis 20 of the columns 18). However, the columns 18 can have a rectangular cross-section such as those illustrated in U.S. Publication No. 2012/0267197 A1 assigned to the assignee of the instant application, the disclosure of which is hereby incorporated by reference in its entirety. Other cross-sections (e.g., square, oval or polygonal shapes) are also contemplated. The columns 18 can be substantially hollow to receive another column 18 from above. Additionally, the rungs 24 can be substantially hollow such that a pair of latch assemblies (not shown) can be housed in the hollow rung 24.

As described above, the rungs 24 are connected to the columns 18 by a plurality of connector assemblies 26. The connector assemblies 26 can have latch assemblies housed in the hollow portion of each rung 24 to unlock or selectively lock relative axial movement between adjacent columns 18. Such connector assemblies 26 are described in U.S. Pat. No. 8,387,753 B2 and U.S. Pat. No. 6,883,645 both assigned to the assignee of the instant application, the disclosure of each of which is hereby incorporated by reference in its entirety. Each latch assembly has a release button 46 that can be manually actuatable to unlock the selectively locked relative axial movement between two adjacent columns 18. In the embodiment shown in FIG. 1A, the release buttons may be slid inwardly along a front surface 48 of rung 24 (e.g., by the thumbs of the user), to unlock their respective latch assemblies. Thus, when release buttons on both the right and left hand sides of rung 24 are actuated, adjacent columns 18 are permitted to move axially. Gravity can cause such columns 18 and their rung 24 to collapse downward to assume a position similar to rungs 24 shown in the collapsed portion of the ladder 10 shown in FIG. 1A.

In some cases, the ladder 10 can comprise a first ladder portion 50 and a second ladder portion 54 that are coupled to each other in a hinged fashion. For instance, the ladder 10 is foldable such that the first and second ladder portions 50, 54 form a first angle 58 therebetween. The first angle 58 can be equal to between about zero degrees and about 180 degrees. In FIG. 1A, the first angle 58 is about zero degrees. In FIGS. 1B and 1C, the first angle 58 is about 180 degrees. In FIG. 1D, the first angle 58 is about 30 degrees. Each of the first and second ladder portions 50, 54 can have a first stile 14 and a second stile 16 having a plurality of columns 18, and a plurality of rungs 24 extending between the columns 18. The first and second ladder portions 50, 54 can be locked at various angular positions by hinge mechanisms known in the art. An exemplary hinge mechanism 60 is described and illustrated in the co-pending U.S. application Ser. No. 14/557,944 titled "Foldable ladder", assigned to the assignee of the instant application, filed on Dec. 2, 2014, the disclosure of which is hereby incorporated by reference in its entirety.

Figure 2A:
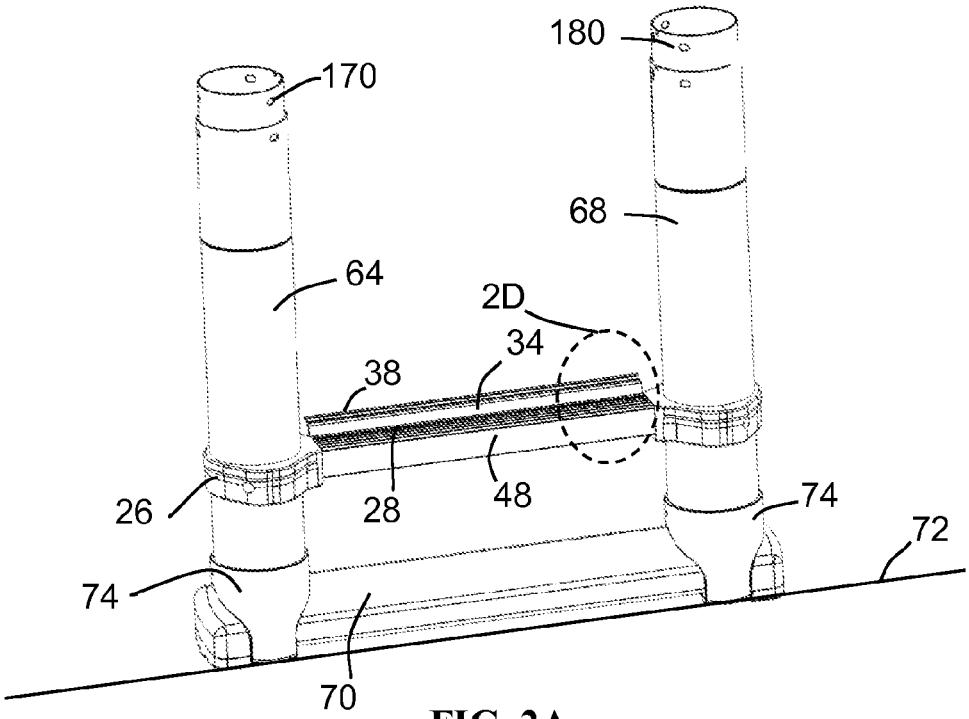
FIG. 2A is a close-up perspective view of a portion 2A of the ladder shown in FIG. 1A.
Figure 2B:
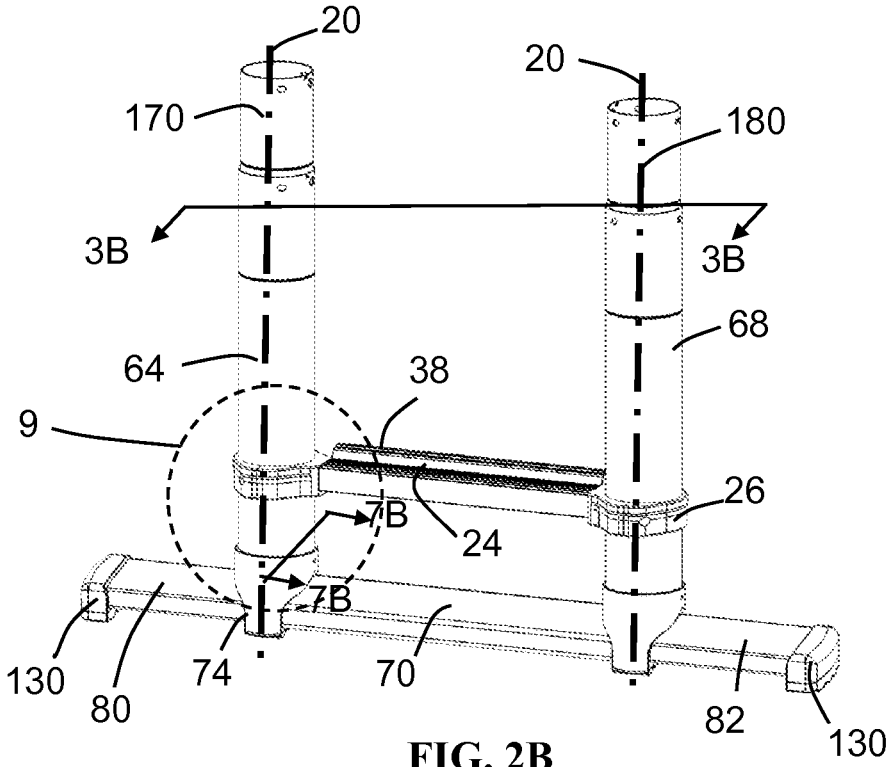
FIG. 2B is a perspective view of the ladder of 2A showing the stabilizers in an extended position.
Figure 8:
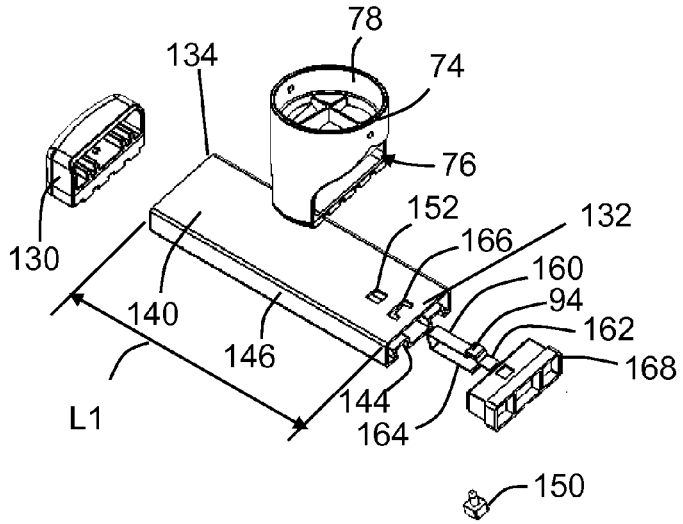
FIG. 8 is an exploded perspective view of the stabilizer of FIG. 6 shown along with a connector.

Referring now to FIGS. 2A and 2B, the first stile 14 comprises a first column 64 and the second stile 16 comprises a second column 68. The first and second columns 18 each have a hollow body. The first and second columns 18 can be connected to a first stabilizer housing 70. The first stabilizer housing 70 and the first and second columns 18 can be proximal to a floor surface 72 on which the ladder 10 is positioned during use. The first stabilizer housing 70 and the first and second columns 18 can be coupled by a pair of connector assemblies 26 as described above. Alternatively, a connector 74 can fixedly connect the first and second columns 18 to the first stabilizer housing 70. The connector 74 can have a connector opening 76 (e.g., best illustrated in FIG. 8) for receiving the first stabilizer housing 70. The connector 74 additionally receives the first and second columns 18 in an interior surface 78 thereof. The first and second columns 18 form a friction fit with the interior surface 78 of the connector 74.

Figure 2C:
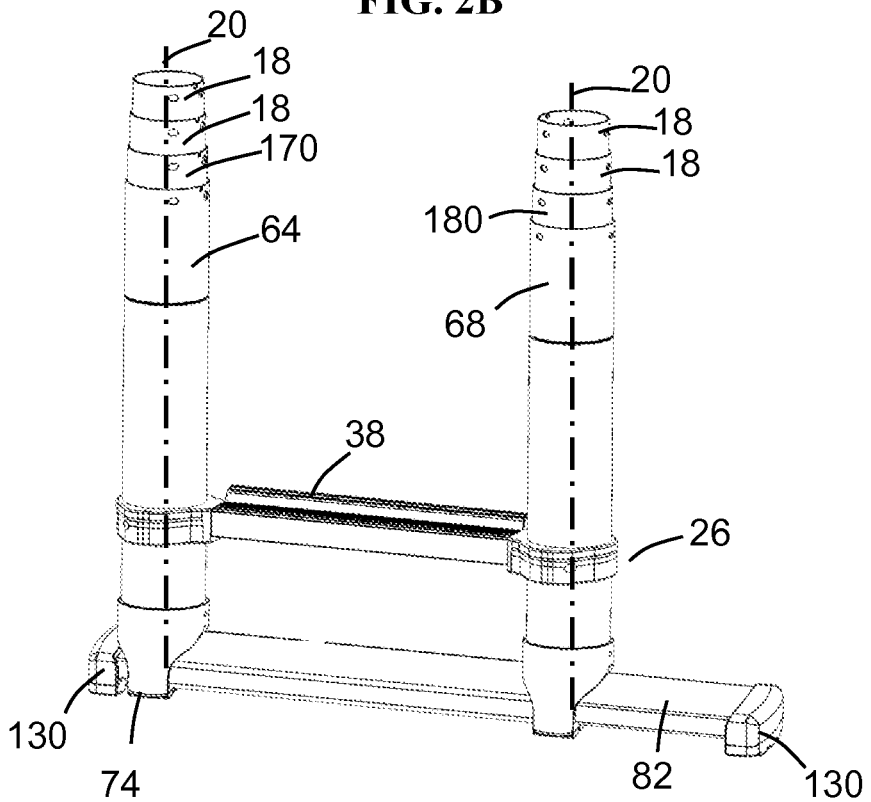
FIG. 2C is a perspective view of the ladder of 2A showing a stabilizer in an extended position and a stabilizer in a collapsed position.
Figure 2D:
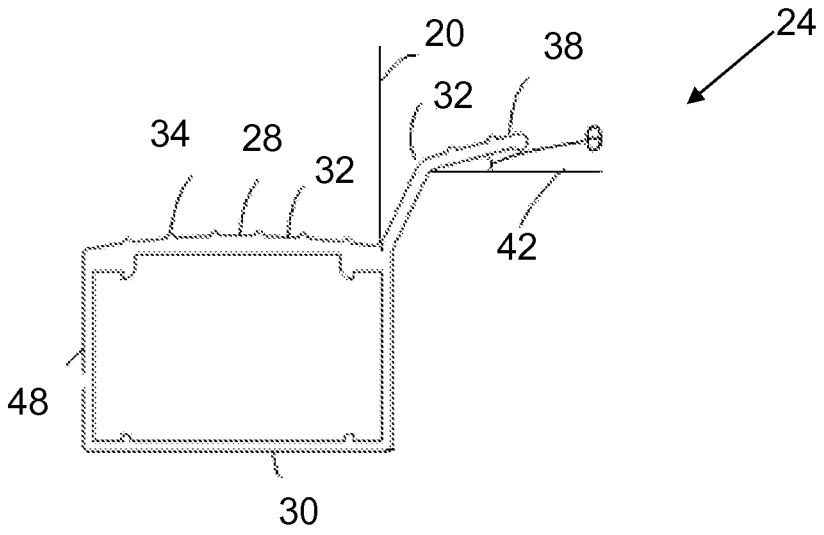
FIG. 2D is a perspective view of a portion 2D shown in FIG. 2A.

Referring back to FIGS. 2A and 2B, the ladder 10 can include a first stabilizer 80 and a second stabilizer 82 connected to the first stabilizer housing 70. The first and second stabilizers 80, 82 can each move between an extended position and a collapsed position. The first and second stabilizers 80, 82 can be substantially similar although the right hand side stabilizer 82 can be a mirror image of the left hand side stabilizer 80 (about the axis 20 of the columns 18). The first and second stabilizers 80, 82 are movable slidingly with respect to the first stabilizer housing 70. In some cases, the first and second stabilizers 80, 82 can be extended independently. For instance, the first stabilizer 80 can be extended while the second stabilizer 82 is collapsed and vice versa, as illustrated in FIG. 2C. As seen in FIGS. 2B and 2C, the first and second stabilizers 80, 82 can collapse into a hollow body portion 86 of the first stabilizer housing 70 in the collapsed position. In the extended position, the first and second stabilizers 80, 82 extend out of the hollow body portion 86 of the first stabilizer housing 70 past one of the first and second stiles in a direction substantially normal to the axis 20 of the plurality of columns 18.

Figure 3A:
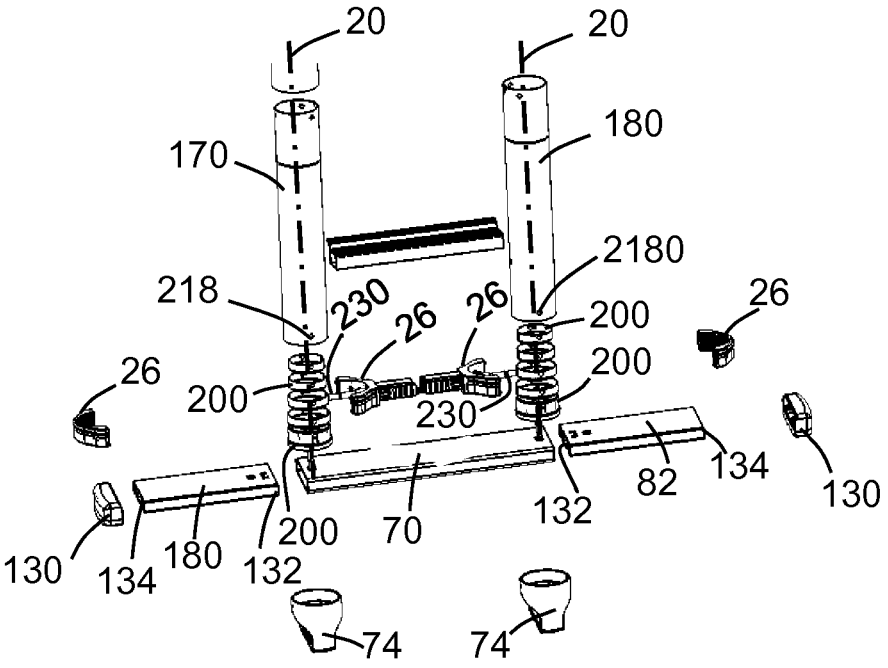
FIG. 3A is an exploded perspective view of the ladder portion illustrated in FIG. 2A with the first and second columns hidden from view to show certain internal detail.
Figure 3B:
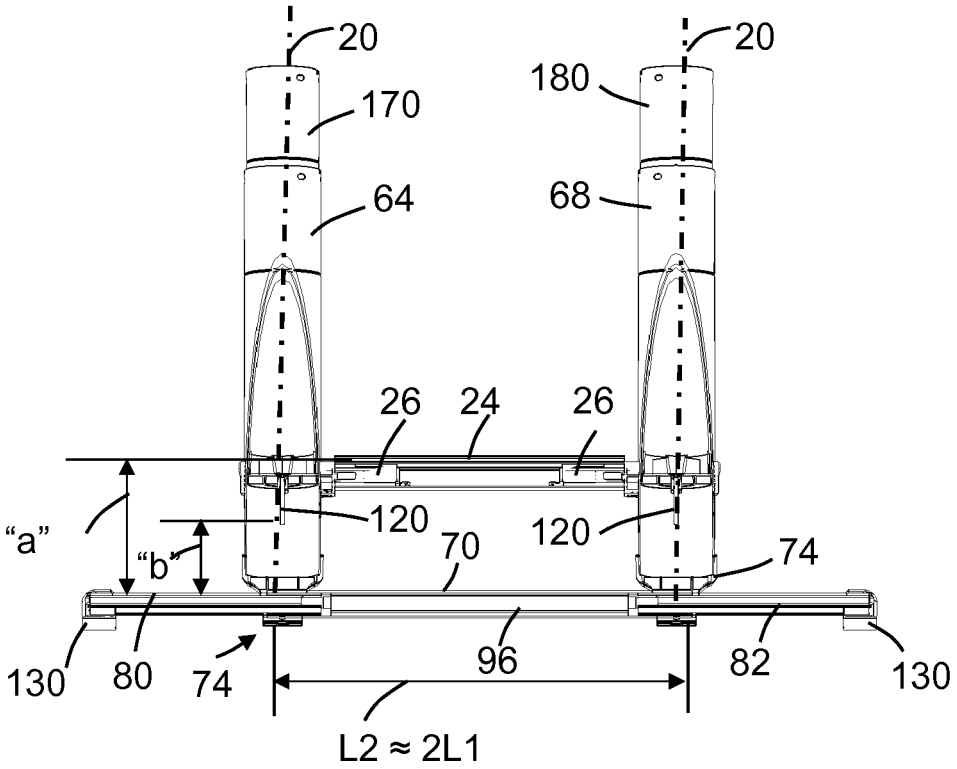
FIG. 3B is a cross-sectional front view of the ladder portion shown in FIG. 2B, with the cross-section taken along the plane 3B-3B.
Figure 4:
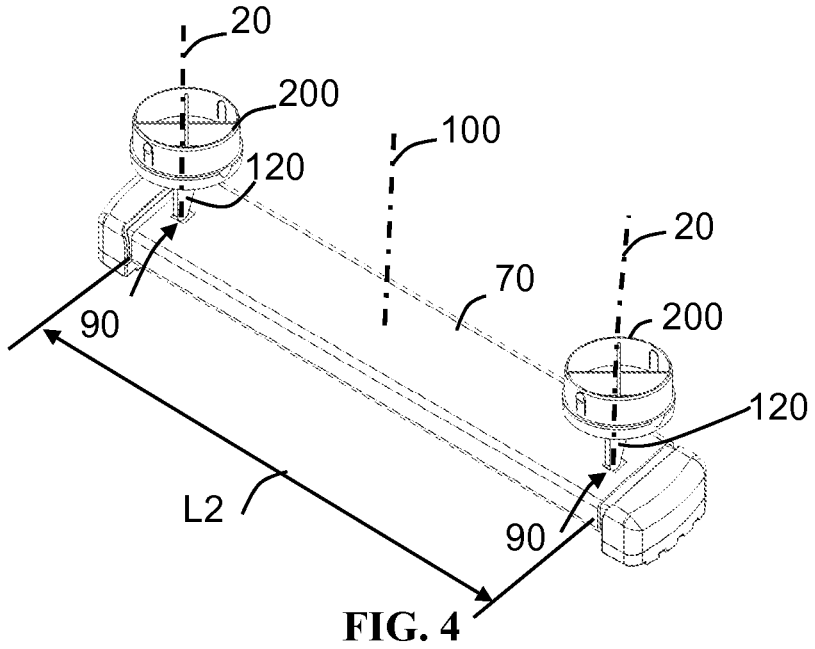
FIG. 4 is a perspective view showing a first stabilizer housing and first and second air dampers with a stabilizers shown in a collapsed state according to an embodiment.
Figure 5:
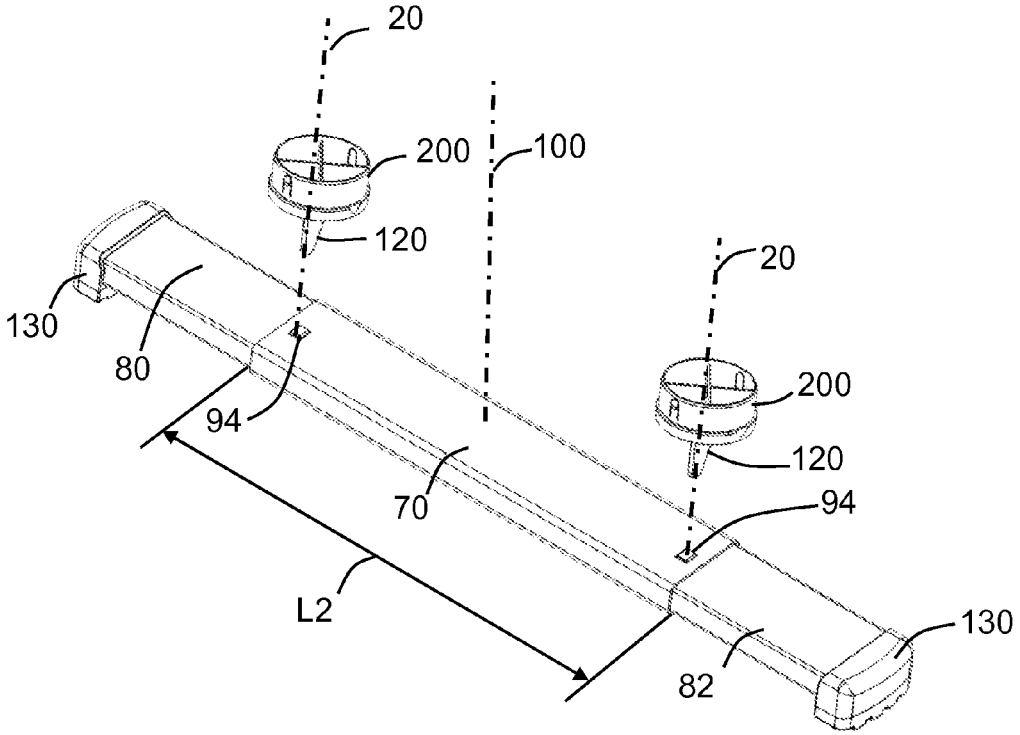
FIG. 5 is a perspective view showing the stabilizers of FIG. 4 shown in an extended state.

Referring now to FIGS. 3A-3B and 4, the first stabilizer housing 70 has an aperture 90 defined coaxially with the axis 20 of the plurality of columns 18. As shown in FIG. 5, each of the first and second stabilizers 80, 82 has a locking button 94 that can protrude past the aperture 90 defined on the first stabilizer housing 70 to lock the stabilizer 80, 82 in an extended position. The locking button 94 can be generally in a depressed position when the first and second stabilizers 80, 82 are collapsed and abut against an inner surface 96 of the first stabilizer housing 70 and are proximal to a centerline 100 of the first stabilizer housing 70 through which the locking buttons can protrude past when the first and second stabilizers 80, 82 are in a collapsed position. When the first and second stabilizers 80, 82 are drawn out to an extended position, the locking buttons remain depressed and abut against an inner surface 96 of the first stabilizer housing 70. Upon encountering the aperture 90, the locking buttons protrude past them and thereby lock the first and second stabilizers 80, 82 and prevent them from moving slidingly with respect to the first stabilizer housing 70. When the locking buttons protrude past the aperture 90, the locking buttons lock the stabilizers 80, 82 in the extended position. Such configurations can be used to improve the stability of the ladder 10 by having a center of gravity of the ladder 10 fall within the footprint of the ladder 10.

Referring back to FIG. 3A-3B, the first and second columns 18 each have a flange 120 positioned in the hollow body of the first and second columns 18 coaxially with the axis 20 of the plurality of columns 18. FIG. 4 illustrates a close-up perspective view of the flanges of the first and second columns 18 (not shown in FIG. 4). As seen in FIGS. 3A-3B and 4, the flange 120 of the first and second columns 18 can depress the locking button 94 away from the aperture 90, thereby releasing the first and second stabilizers 80, 82 from their locked position, as a result of which the first and second stabilizers 80, 82 move generally inwardly into the hollow body portion 86 of the first stabilizer housing 70. The flanges can be positioned and oriented in the first and second columns 18 such that when a column (e.g., column 170 or column 180 shown in FIG. 2A) above each of the first and second columns 64, 68 nests therein, the flanges are pushed in a direction toward the first stabilizer housing 70 (e.g., from a distance "a" shown in FIG. 3B to a distance "b"). Referring to FIG. 3A-3B, the flange 120 abuts against the locking button 94 protruding past the aperture 90 of the first stabilizer housing 70 due to the telescoping movement of the first column 64 toward the first stabilizer housing 70, the locking button 94 is pushed away from the aperture 90 thereby unlocking the first stabilizer 80 from its extended position and moving it into a collapsed position.

Figure 6:
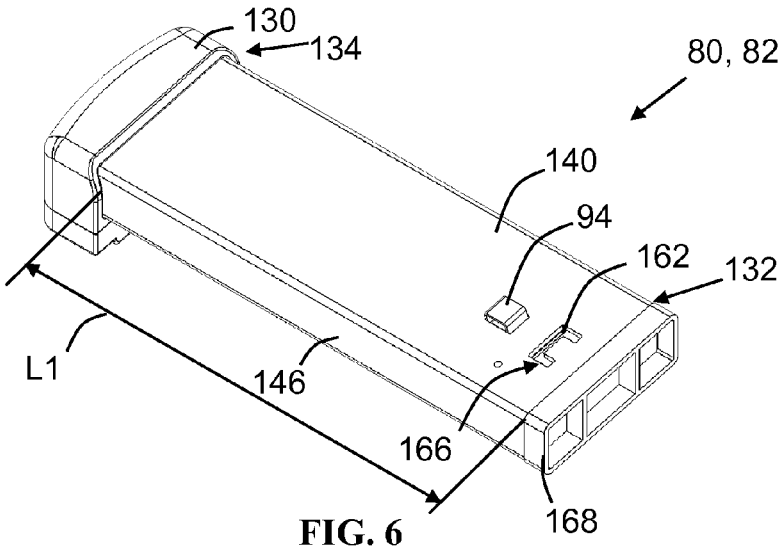
FIG. 6 is a perspective view of a stabilizer according to an embodiment.
Figure 7A:
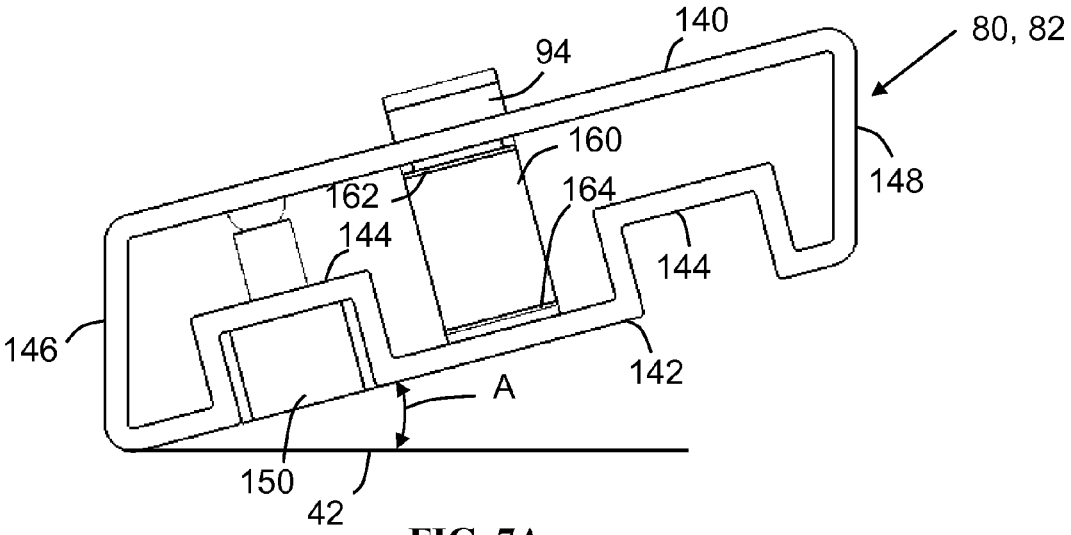
FIG. 7A is a right side view of the stabilizer of FIG. 6 with the caps removed to illustrate internal detail.
Figure 7B:
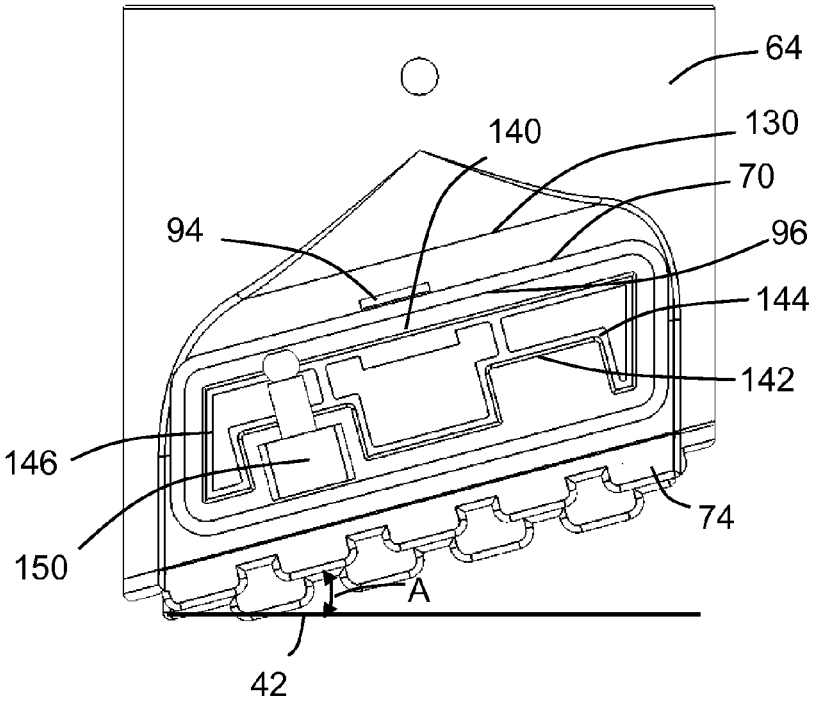
FIG. 7B is a cross-sectional right side view of a portion of FIG. 2B taken along the plane 7B-7B.

FIG. 6 is a perspective view of a stabilizer 80, 82 according to an embodiment of the invention. FIG. 7A is a side view of the stabilizer 80, 82 of FIG. 6 with the end cap 130 removed. As seen in FIGS. 6 and 7A, the stabilizer 80, 82 has a generally hollow body portion with a length "L1" equal to about one-half the length of the first stabilizer housing 70 "L2". The first and second stabilizers 80, 82 shown in the embodiments above, for instance, can both have a length L1, and the first stabilizer housing 70 can have a length L2, allowing both the first and second stabilizers 80, 82 to abut against each other when collapsed. The length of the stabilizer 80, 82 can be measured from a first end 132 of the stabilizer 80, 82 to the second end 134 and may not include the end cap 130 of the stabilizer 80, 82 of any other additional caps. Likewise, the length of the first stabilizer housing 70 can be an end-to-end length of the body portion of the first stabilizer housing 70. The stabilizer 80, 82 is of a parallelogram cross-section to facilitate sliding engagement with the first stabilizer housing 70 (also having a parallelogram cross-section as shown in FIG. 7B). Referring back to FIGS. 6 and 7A, a first surface 140 of the stabilizer 80, 82 is generally planar and a second surface 142 of the stabilizer 80, 82 has one or more recessed tracks 144. The first and second surfaces 140, 142 are generally parallel and opposite to each other, and form an angle "A" with respect to the horizontal plane 42. When positioned in the first stabilizer housing 70, the first surface 140 forms a top surface, the second surface 142 forms a bottom surface 212. The stabilizer 80, 82 also has a third surface 146 and fourth surface 148 that form the parallelogram shape of the stabilizer 80, 82. As described above, other shapes of the stabilizer 80, 82 are also contemplated, corresponding to the shape of the first stabilizer housing 70 (e.g., rectangular).

Referring to FIGS. 7A and 7B, a connecting member 150 connects the stabilizer 80, 82 to the hollow body portion 86 of the first stabilizer housing 70. For instance, the connecting member 150 is a square-headed bolt or screw resting in the recessed portions of the tracks of the stabilizer 80, 82 and forming a frictional fit therewith. One or more ends of the connecting member 150 can rest against inner surface 96 of the first stabilizer housing 70 and facilitate sliding movement of the stabilizer 80, 82 with respect to the first stabilizer housing 70. As mentioned above, the locking button 94 extends past the first surface 140 of the stabilizer 80, 82 (e.g., out of the aperture 90 best illustrated in FIG. 8). The locking button 94 can be spring-biased to protrude out of the aperture 152 of the stabilizer 80, 82, and consequently aperture 90 of the first stabilizer housing 70 by a clamp 160. An end 164 of the clamp 160 is received by the second surface 142 of the stabilizer 80, 82 (e.g., via a slot, not illustrated) and an opposite end 162 of the clamp 160 is received by a slot 166 on the first surface 140 of the stabilizer 80, 82. The stabilizer 80, 82 can also have an end cap 130 having a cross-section greater than the cross-sectional area of the hollow body portion 86 of the first stabilizer housing 70. The end cap 130 therefore does not collapse into the first stabilizer housing 70 when the stabilizer 80, 82 is collapsed. Such embodiments facilitate accessing the stabilizer 80, 82 manually to extend it from its collapsed position. In addition to the end cap 130, the stabilizer 80, 82 can have an additional cap 168 positioned proximal to the centerline 100 of the first stabilizer housing 70 and within the hollow body portion 86 of the first stabilizer housing 70.

Figure 9:
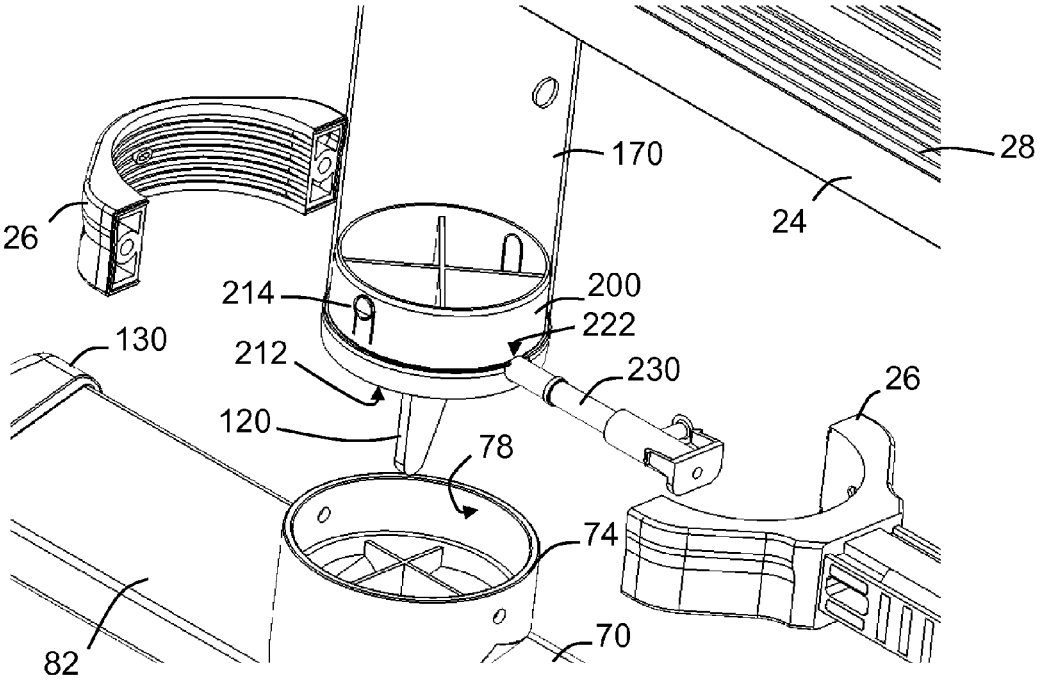
FIG. 9 is a close-up exploded view of a portion 9 shown in FIG. 2B.

As mentioned above, and referring now to FIG. 9, the locking buttons of the stabilizers 80, 82 can be actuated by flanges positioned in the first and second columns 18 due to nesting telescoping movement of the plurality of columns 18 into the first and second columns 18 (not shown in FIG. 9). FIG. 9 illustrates a third column 170 positioned above the first column 64. Likewise, a fourth column 180 can be positioned above the second column 68 (best seen in FIG. 2A). Referring back to FIG. 9, the third column 170 can nest within and extend from the first column 64 along the axis 20 of the plurality of columns 18. In some cases, each column can include an air damper 200 positioned coaxially with the axis 20 of the column to limit the relative axial movement of the plurality of columns 18. In the illustrated embodiment, the air damper 200 caps a bottom perimeter edge 210 of the third column 170 to restrict air flow through the third column 170. An exemplary air damper 200 is described in U.S. Publication No. 2012/0267197 A1 assigned to the assignee of the instant application, the disclosure of which is hereby incorporated by reference in its entirety. As illustrated, the flange 120 can extend from a bottom surface 212 of a first air damper 200 positioned within the first column 64 of the first stile 14. As seen in FIG. 9, the first air damper 200 is coaxial with the locking button 94 of the first stabilizer 80 when the locking button 94 protrudes past the aperture 90 of the first stabilizer housing 70 in an extended position.

Figure 10:
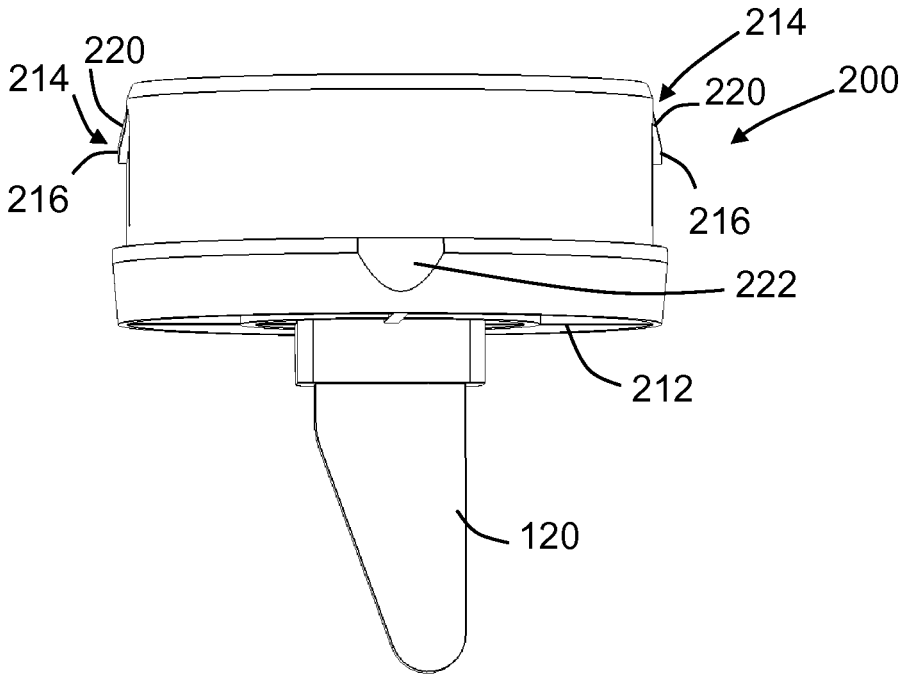
FIG. 10 is a front view of an air damper according to an embodiment.
Figure 11:
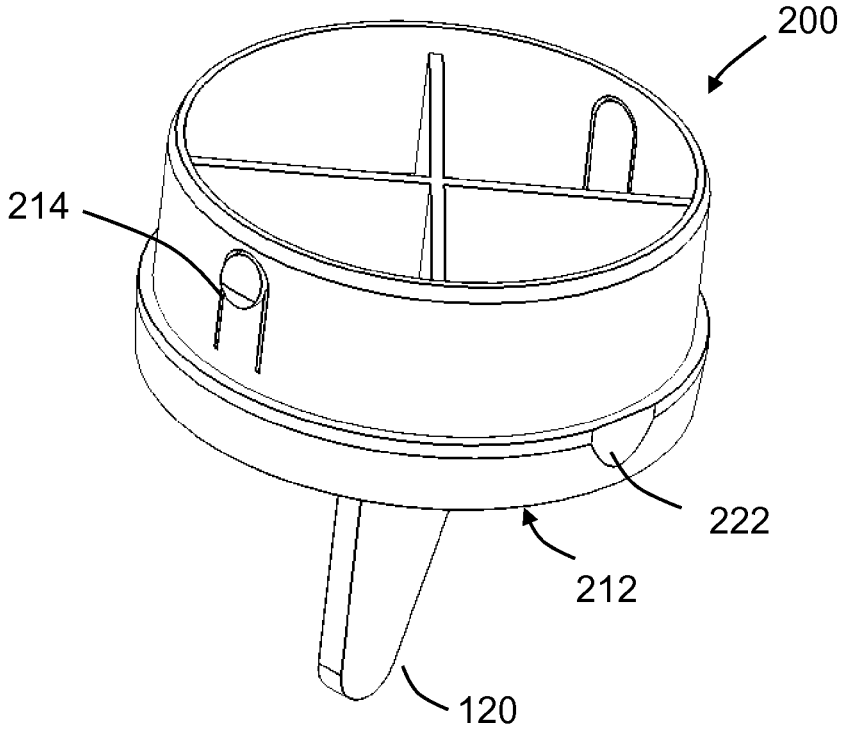
FIG. 11 is a perspective view of the air damper of FIG. 10.

Referring now to FIGS. 10 and 11, the air dampers can each have a tab 214 defined on a perimeter surface thereof to facilitate insertion into the third column 170 and prevent removal of the air damper 200 from the third column 170. The tab 214 has a tapered leading edge 216 facilitating engagement with a corresponding opening 218 of the third column 170, and an upright trailing edge 220 preventing removal of the tapered tab 214 from the third column 170. The air damper 200 is coupled to the third column 170 such that the tabs of the air damper 200 protrude past corresponding openings (best seen in FIG. 3A) of the third column 170. The air damper 200 can be positioned such that the openings are proximal to the bottom perimeter edge 210 of the third column 170. The air damper 200 is coupled to the third column 170 so that the nesting movement of the third column 170 toward the first column 64 moves the flange 120 of the air damper 200 toward the aperture 90 of the first stabilizer housing 70. As additional columns 18 descend toward the first column 64 from above, the air damper 200 is moved even more proximal to the first stabilizer housing 70 until the flange 120 abuts against the locking button 94 protruding past the aperture 90. The flange 120 of the first air damper 200 can then push the locking button 94 away from the aperture 90 and collapses the first stabilizer 80 when the third column 170 is fully nested within the first column 64. The air damper 200 can also have a recessed portion 222 on a perimeter surface thereof. The recessed portion 222 can receive a locking pin 230 (as shown in FIG. 9) that locks the first and third columns 18 to prevent relative axial movement therebetween.

While the embodiments above have been described with respect to one half of a foldable ladder 10 (e.g., the first ladder portion 50), the stabilizers 80, 82 of the second ladder portion 54 are substantially similar to those of the first ladder portion 50. For instance, the second ladder portion 54 can comprise a second stabilizer housing 240 having a pair of stabilizers 80, 82 that extend past each of the first and second stiles of the second ladder portion 54 in a direction substantially normal to the axis 20 of the plurality of columns 18 and collapse into a hollow portion of the second stabilizer housing 240. The second stabilizer housing 240 can be proximal to the floor surface 72 when the first and second ladder portions 50, 54 form angles such as between about zero degrees and about 60 degrees (e.g., 0 degrees as illustrated in FIG. 1A and 30 degrees as illustrated in FIG. 1D), whereas the second stabilizer housing 240 is distal to the floor surface 72 when the first and second ladder portions 50, 54 form angles greater than 90 degrees (e.g., 180 degrees as illustrated in FIGS. 1B and 1C). The stabilizers 80, 82 of the second ladder portion 54 can collapse into the hollow portion of the second stabilizer housing 240 when the plurality of columns 18 are nested within each other in a telescopic fashion to collapse the ladder 10 into a collapsed position (e.g., as seen in FIGS. 1A and 1B), and wherein the stabilizers 80, 82 of the second ladder 10 portions can extend out of the second stabilizer housing 240 when the plurality of columns 18 extended in a telescopic fashion (e.g., as seen in FIGS. 1C and 1D).

In use, when the columns 18 of the first and second ladder portions 50, 54 are extended, the flange 120 moves away from the aperture 90 of the first stabilizer housing 70 of the first ladder portion 50 and the second stabilizer housing 240 of the second ladder portion 54. The stabilizers 80, 82 of the first and second ladder portions 50, 54 extend out of the first and second stabilizer housings 70, 240 respectively until the locking buttons protrude past the apertures inline with the axis 20 of the columns 18. The first and second ladder portions 50, 54 can be locked at a desired angular position. The ladder 10 can be folded and the stabilizers 80, 82 can be collapsed during storage. To collapse the stabilizers 80, 82, the first and second ladder portions 50, 54 can first be unlocked from a desired angular position. The columns 18 of each of the first and second ladder portions 50, 54 can then be collapsed until a third column 170 fully nests inside the first column 64 and a fourth column 180 fully nests inside the second column 68. The flanges of air dampers of the third and fourth columns 18 abut against the aperture 90 and the locking button 94 protruding past it when the third and fourth columns 18 fully nest within the first and second columns 18. The flange 120 pushes the locking button 94 inwardly into the hollow portion of the respective stabilizer housing (e.g., first and second stabilizer housing 70, 240), and thereby collapses the stabilizers 80, 82 for storage.

Certain embodiments of the telescoping ladder 10 illustrated herein can improve safety by stabilizing the ladder 10 during use. For instance, some embodiments of the telescoping ladder 10 with stabilizers 80, 82 extending therefrom ensure that the center of gravity of the ladder 10 always falls within the horizontal extent (e.g., footprint) of the ladder 10 during use, thereby minimizing or eliminating any moments that may overturn the ladder 10 during operation. Additionally, the stabilizers 80, 82 can be collapsed during storage, thereby facilitating compact footprint of the ladder 10 when not in use. Further, collapsing the columns 18 of the ladder 10 automatically collapses the stabilizers 80, 82 thereby offering ease of use.

Thus, embodiments of the telescoping ladder with stabilizers are disclosed. Although the present embodiments have been described in considerable detail with reference to certain disclosed embodiments, the disclosed embodiments are presented for purposes of illustration and not limitation. One skilled in the art will appreciate that various changes, adaptations, and modifications may be made without departing from the spirit of the invention.

What is claimed is:

1. A telescoping ladder, comprising:

a first stile, a second stile, the first and second stiles each having a plurality of columns disposed in a nested arrangement for relative axial movement in a telescopic fashion along an axis of the plurality of columns between an extended position and a collapsed position, wherein, a first column of the first stile and a second column of the second stile each having a hollow body, the first and second columns being proximal to a floor surface on which the ladder is positioned, the first column having a flange positioned in the hollow body of the first column coaxially with the axis of the plurality of columns, a plurality of rungs extending between the first stile and the second stile, each rung connected to a column of the first stile and a column of the second stile;

a first stabilizer housing being connected to the first and second columns, the first stabilizer housing being proximal to the floor surface on which the telescoping ladder is positioned, the first stabilizer housing having a hollow body portion; and a first stabilizer slidingly connected to the first stabilizer housing, the first stabilizer adapted to move between an extended position and a collapsed position, wherein, in the extended position, the first stabilizer extends out of the hollow body portion of the first stabilizer housing, the first stabilizer extending past the first stile in a direction substantially normal to the axis of the plurality of columns in the extended position, and the first stabilizer adapted to collapse into the hollow body portion of the first stabilizer housing in the collapsed position, the first stabilizer comprising a locking button adapted to protrude past an aperture defined on the first stabilizer housing to lock the first stabilizer in its extended position, wherein, the locking button and the aperture are coaxial to the axis of the plurality of columns in the extended position of the first stabilizer, and wherein the flange abuts against the locking button protruding past the aperture of the first stabilizer housing due to the telescoping movement of the plurality of columns in a direction toward the first stabilizer housing, the abutment of the flange against the locking button pushing the locking button away from the aperture and thereby unlocking the first stabilizer from its extended position and into the collapsed position.

2. The telescoping ladder of claim 1, further comprising a plurality of air dampers positioned coaxially within the plurality of columns, the air dampers adapted to limit the relative axial movement of the plurality of columns.

3. The telescoping ladder of claim 2, wherein the flange extends from a bottom surface of a first air damper of the plurality of air dampers, the first air damper being coaxial with the locking button of the first stabilizer when the locking button protrudes past the aperture of the first stabilizer housing in the extended position of the first stabilizer.

4. The telescoping ladder of claim 3, further comprising a second stabilizer connected to the first stabilizer housing, the second stabilizer being actuable by a flange positioned on the bottom surface of of the plurality of air dampers a second air damper, the second stabilizer being actuable between the extended position to extend past the plurality of columns in a direction perpendicular to the axis of the plurality of columns, and the collapsed position to collapse slidingly into the hollow body portion of the first stabilizer housing.

5. The telescoping ladder of claim 4, wherein the first air damper is coupled to a third column such that the nesting movement of the third column toward the first column moves the flange of the first air damper toward the aperture of the first stabilizer housing.

6. The telescoping ladder of claim 5, wherein the first air damper has a tab defined on a perimeter surface thereof, the tab having a tapered leading edge facilitating engagement with a corresponding opening of the third column, and an upright trailing edge preventing removal of the tab from the third column.

7. The telescoping ladder of claim 6, wherein the flange of the first air damper is adapted to push the locking button away from the aperture and collapses the first stabilizer when the third column is fully nested within the first column.

8. The telescoping ladder of claim 7, wherein the first air damper is coupled to the third column such that the tabs of the first air damper protrude past corresponding openings of the third column, the openings of the third column being proximal to a bottom perimeter edge of the third column.

9. The telescoping ladder of claim 4, wherein the first and second stabilizers have a length equal to about one-half of a length of the first stabilizer housing.

10. The telescoping ladder of claim 1, wherein the telescoping ladder is foldable, the telescoping ladder comprising;

a first ladder portion defined by and including the first and second stiles, the plurality of rungs, the first stabilizer housing and the first stabilizer, a second ladder portion hingedly connected to the first ladder portion such that the first and second ladder portions are rotatable about a hinge axis, the second ladder portion comprising:

a first stile, a second stile, the first and second stiles of the second ladder portion each having a plurality of columns disposed in a nested arrangement for relative axial movement in a telescopic fashion along an axis of the plurality of columns between an extended position and a collapsed position, and a plurality of rungs extending between the first and second stiles of the second ladder portion, each rung connected to a column of the first stile of the second ladder portion and a column of the second stile of the second ladder portion.

11. The foldable telescoping ladder of claim 10, wherein the first and second ladder portions are foldable such that they form a first angle therebetween, the first angle being equal to between about zero degrees and about 180 degrees.

12. The foldable telescoping ladder of claim 11, further comprising a second stabilizer housing of the second ladder portion, the second stabilizer housing comprising a pair of stabilizers each adapted to extend past each of the first and second stiles of the second ladder portion in a direction substantially normal to the axis of the plurality of columns of the second ladder portion and collapse into a hollow portion of the second stabilizer housing.

13. The foldable telescoping ladder of claim 12, wherein the second stabilizer housing is proximal to the floor surface on which the ladder is mounted when the first and second ladder portions form an angle of about zero degrees therebetween.

14. The foldable telescoping ladder of claim 12, wherein the pair of stabilizers of the second ladder portion are adapted to collapse into the hollow body portion of the second stabilizer housing when the plurality of columns of the second ladder portion are nested within each other in a telescopic fashion to collapse the ladder into a collapsed position, and wherein the pair of stabilizers of the second ladder portion are adapted to extend out of the second stabilizer housing when the plurality of columns of the second ladder portion are adapted to extend in a telescopic fashion.

15. The foldable telescoping ladder of claim 10, wherein each stabilizer of the first ladder portion and the second ladder portion is extensible independently and separately of the other stabilizers.

* * * * *